US010900107B2

(12) United States Patent
Tundal et al.

(10) Patent No.: US 10,900,107 B2
(45) Date of Patent: Jan. 26, 2021

(54) METHOD FOR THE MANUFACTURING OF AL—MG—SI AND AL—MG—SI—CU EXTRUSION ALLOYS

(71) Applicant: NORSK HYDRO ASA, Oslo (NO)

(72) Inventors: Ulf Tundal, Sunndalsøra (NO); Jostein Røyset, Sunndalsøra (NO); Oddvin Reiso, Sunndalsøra (NO); Øystein Bauger, Trondheim (NO)

(73) Assignee: NORSK HYDRO ASA, Oslo (NO)

( * ) Notice: Subject to any disclaimer, the term of this patent is extended or adjusted under 35 U.S.C. 154(b) by 790 days.

(21) Appl. No.: 14/914,851

(22) PCT Filed: Aug. 28, 2014

(86) PCT No.: PCT/NO2014/000040

§ 371 (c)(1),
(2) Date: Feb. 26, 2016

(87) PCT Pub. No.: WO2015/030598

PCT Pub. Date: Mar. 5, 2015

(65) Prior Publication Data

US 2016/0222499 A1 Aug. 4, 2016

(30) Foreign Application Priority Data

Aug. 30, 2013 (NO) ..... 20131162

(51) Int. Cl.

| | |
|---|---|
| ***C22F 1/04*** | (2006.01) |
| ***C22F 1/043*** | (2006.01) |
| ***C22F 1/05*** | (2006.01) |
| ***C21D 9/00*** | (2006.01) |
| ***C22C 21/02*** | (2006.01) |

(52) U.S. Cl.
CPC ..... *C22F 1/043* (2013.01); *C21D 9/0062* (2013.01); *C22C 21/02* (2013.01); *C22F 1/05* (2013.01)

(58) Field of Classification Search
CPC ..... C22F 1/043
See application file for complete search history.

(56) References Cited

U.S. PATENT DOCUMENTS

| | | | | |
|---|---|---|---|---|
| 3,379,583 | A | 4/1968 | Gruhl et al. | |
| 3,990,922 | A | 11/1976 | Gullotti et al. | |
| 4,909,858 | A * | 3/1990 | Reiso | C22C 21/08 148/549 |
| 4,932,864 | A | 6/1990 | Miyabe | |
| 2012/0247623 | A1 | 10/2012 | Matsuka et al. | |

FOREIGN PATENT DOCUMENTS

| | | |
|---|---|---|
| WO | 02/38821 | 5/2002 |

OTHER PUBLICATIONS

International Search Report dated Dec. 4, 2014 in corresponding International Application No. PCT/NO2014/000040.

* cited by examiner

*Primary Examiner* — Christopher S Kessler
(74) *Attorney, Agent, or Firm* — Wenderoth, Lind & Ponack, L.L.P.

(57) ABSTRACT

Method for the manufacturing of an Al—Mg—Si(—Cu) extrusion alloy, the alloy initially being cast to extrusion billet(s), containing in wt. %

Figure 1:
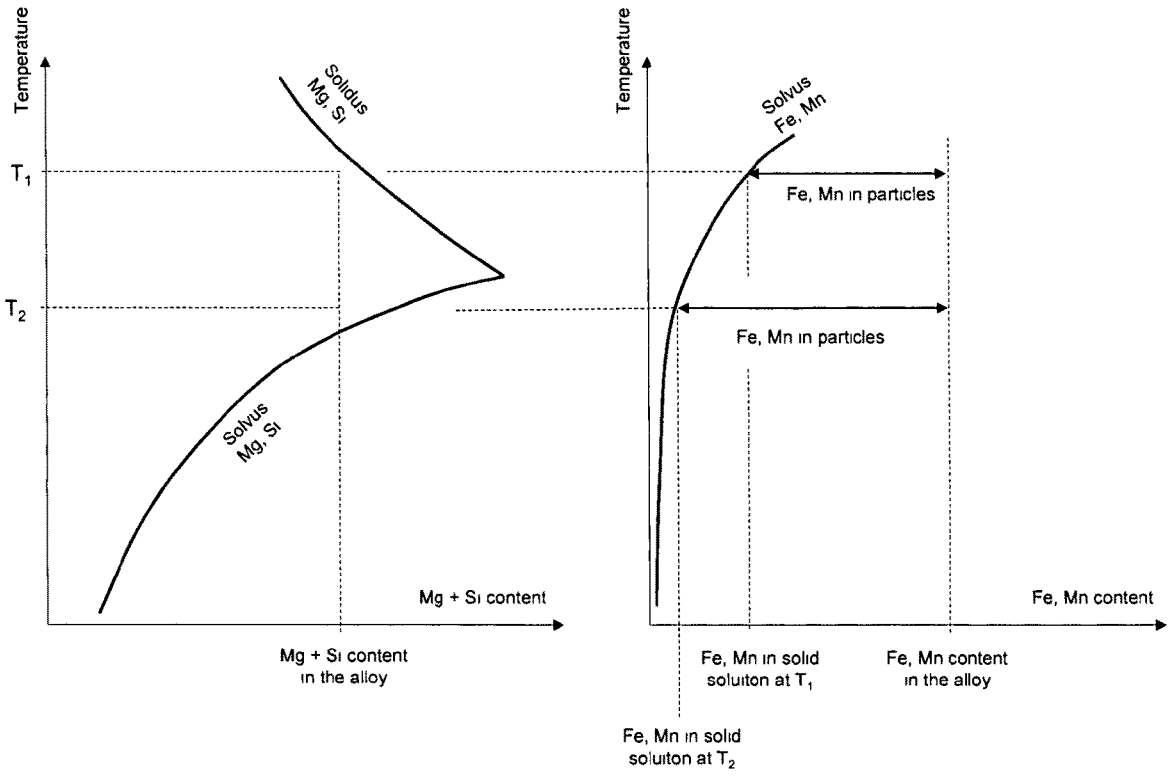

Si: 0.20-1.50
Mg: 0.25-1.50
Fe: 0.05-0.50
Cu: 0.00-1.00
Mn: 0.00-1.00
Cr: 0.00-0.50
Zn: 0.00-0.50
Ti: 0.00-0.20, and including incidental impurities and balance Al.

9 Claims, 6 Drawing Sheets

Extrusion pressure at different ram positions for the two homogenisation cycles H1 and H2

Sketch showing an example of a layout of a conventional continuous homogenisation furnace.

Sketch showing an example of a layout of an improved continuous homogenisation furnace Sketch of a temperature-time chart for homogenisation where the shaded area indicates the temperature-time window encompassed by the invention as defined in the Claims.

Inverse segregation zone of LPC cast billets and conventional gas cushion cast billets of a 6060-alloy after homogenisation at the indicated temperatures. The sluggish Al-Fe-Si particles observed for the conventional billets after homogenisation at 600°C and 605°C are clear indications of partial melting in the ISZ.

METHOD FOR THE MANUFACTURING OF AL—MG—SI AND AL—MG—SI—CU EXTRUSION ALLOYS

The present invention relates to a method for the manufacturing of Al—Mg—Si and Al—Mg—Si—Cu extrusion alloys. For convenience, these two alloy systems are given the common denomination Al—Mg—Si(—Cu) in the following description.

Alloys belonging to the Al—Mg—Si(—Cu)—type are widely used for extrusion purposes. The popularity of these alloys is due to their favorable combination of extrudability, strength and other properties such as formability, weldability and response to surface treatment.

Hardening Elements

The strength of the Al—Mg—Si(—Cu) alloys is mainly achieved through precipitation hardening. Upon proper heat treatment, a fine dispersion of strengthening precipitate particle is formed, and these precipitates impede the movement of dislocations and thereby increase the strength of the alloy. A wide range of precipitate types may form (R Holmestad et al., *Proc.* 12$^{th}$ Int. Conf. on Aluminium Alloys, Sep. 5-9, 2010, Yokohama, Japan pp 30-39), and the type of precipitates that actually forms depends on the alloy composition and thermomechanical processing. All the known types of strengthening precipitates in Al—Mg—Si(—Cu) alloys have the common characteristic that they mainly consist of two or more of the elements Al, Mg, Si and Cu. In terms of the present description of the invention, it is convenient to refer to the alloying elements Mg, Si and Cu as "hardening elements".

Within the solubility limit of the Al—Mg—Si(—Cu) alloys, adding more of the hardening elements Mg, Si and Cu to an alloy in general leads to a higher strength potential of the alloy. The hardening elements do, however, also have a markedly negative effect on the extrudability of the alloy. Therefore, an alloy for a particular strength requirement normally has an amount of hardening elements that is tuned to meet the strength requirement, and thereby minimizing the adverse effect of the hardening elements on the productivity.

Non-Hardening Elements

Al—Mg—Si(—Cu) alloys also contain other elements, either added by purpose or present as an impurity. For the present description, it is convenient to refer to all alloying elements except for Mg, Si or Cu as "non-hardening elements". A further description of some of the most common non-hardening elements is given below.

Fe is an inevitable impurity in commercial aluminium production, and in Al—Mg—Si(—Cu) alloys a Fe content within the range 0.05-0.5 wt. % is typically found. The majority of the common alloys have a Fe content within the range 0.07-0.3 wt. %. The Fe content is important for controlling the grain structure during the homogenization, and it is also important for the anodizing response of extruded profile. Different Fe contents may be desired for different products.

Mn is often added to Al—Mg—Si(—Cu) alloys. Depending on the alloy type, the purpose can be either to control the type of non-hardening AlFeSi-based particles in the alloy, to improve the toughness of the alloy, or to control the grain structure of the alloy.

Cr and/or Zr is added to some Al—Mg—Si(—Cu) alloys, normally either to improve the toughness of the alloy or to control the grain structure.

Ti is another element commonly found in Al—Mg—Si(—Cu) alloys. The main source for Ti is through additions of Ti containing grain refiner. The Ti will be tied up in particles that are the nuclei for grain formation in the melt, but in some cases a certain level of Ti will be in solid solution in the alloy.

In some Al—Mg—Si(—Cu) alloys, V is added for the purpose of improving crush performance of the alloy.

Homogenization

After casting, Al—Mg—Si(—Cu) alloys are normally subjected to a homogenization heat treatment. A common homogenization practice is to heat the alloy to a temperature in the range 560-590° C. and keep it at that temperature between 1-5 hours. For some alloys it may be useful to apply temperatures and times outside the range indicated above. After the holding segment the alloys are cooled with forced air to room temperature, typical average cooling rates from 500° C. to 250° C. are in the range 250° C./h-500° C./h.

The primary purpose of homogenization is to level out micro segregations of the hardening elements. This is achieved within short time at the common homogenization temperatures indicated above. In addition, homogenization leads to changes in the type, size- and shape-distribution of the non-hardening AlFeSi-based particles that are found in the alloy. It is a common perception that it is beneficial to achieve a high degree of transformation from the β-AlFeSi to the α-AlFeSi particle type, and to have a high degree of spheroidisation of the AlFeSi-particles. A high homogenization temperature is beneficial for both particle transformation and for the degree of spheroidisation.

In some alloys containing one or more of the elements Mn, Cr and Zr an additional purpose of the homogenization is also to form dispersoid particles. During homogenization, Mn, Cr and Zr form particles with average diameter typically within the range 10-300 nm. These particles are commonly referred to as dispersoids. The dispersoids play a role in improving the toughness and controlling the grain structure of the extruded profile. In some alloys, such as some alloys of the Al—Mn type, dispersoids are one of the main contributors of the strength of the alloy. In Al—Mg—Si(—Cu) alloys, however, the dispersoids have per se only a minor effect on the strength of the extruded and precipitation hardened profile. They may, however, have a considerable effect on the extrudability of the alloy. Increasing the number of dispersoids does in general lead to lower extrudability.

Dispersoids Versus Solid Solution, and Extrudability.

In extrusion of non-age-hardenable alloys, in particular those of the Al—Mn type, an optimization of strength and extrudability may be achieved by using an unconventional cooling after homogenization. A controlled level of dispersoids is desired for strength and microstructure control in these alloys, and the homogenization temperature chosen for such alloys is often closely correlated to the amount of dispersoids that is desired in the alloy. The amount of Mn in solid solution has, however, in general a weaker effect on strength and microstructure control than Mn in dispersoids. Still, Mn in solid solution has a marked influence on the extrudability of the alloys. The solubility of Mn decreases with decreasing temperature. Therefore, a cooling-practice after homogenisation is sometimes employed, where the temperature is slowly brought from the holding temperature down to a temperature where the Mn solubility is significantly lower, thereby allowing more Mn to go from solid solution and to dispersoids. Such homogenization practices are described for several patent applications for Al—Mn-type alloys (G. J. Marshal: Patent WO 97/06284, N. C. Parson, A. Maltais: Patent WO 2009/149542). A similar effect can be achieved by employing a two-step homogenization procedure, where the temperature of the second step is lower than the temperature of the first step (G. Marchand: Norwegian patent 118817). Similar procedures with similar working principles are described for other non-age-hardenable alloys (T. Yoichiri, S. Satoru, O. Tsutomu, N. Kozo: Japanese patent JP63004049)

For the age hardenable alloys, however, the effect of Fe, Mn and other non-hardening elements in solid solution on the extrudability has been largely disregarded in the technical literature. For the Al—Mg—Si(—Cu) alloys, the main effect of alloy constitution on extrudability will be dictated by the amount of hardening elements in the alloy, whether the hardening elements are in solid solution or not, and the type- and size-distribution of particles formed by the hardening elements. For Al—Mg—Si(—Cu) alloys containing significant amounts of one or more of the dispersoid-forming elements Mn, Cr and Zr an effect of the number density and volume fraction of dispersoids on the extrudability is described in the literature. The effect of solid solution level of these elements, or of Fe, has not been considered to be of importance. Thus, homogenization schemes for improving extrudability have had an entirely different focus. A well-known example is the principle of interrupted cooling, where the homogenized material is cooled rapidly down to a temperature where the hardening elements may start to precipitate, thereafter cool at a slower rate to allow a controlled fraction of the hardening elements to precipitate into a controlled size distribution of particles, where after a faster cooling down to room temperature is employed. Such a procedure is described in a patent application (A. J. Bryant, D. J. Field, E. P. Butler: U.S. Pat. No. 4,861,389). The working principle is to remove a fraction of the hardening elements from solid solution, thereby reducing the deformation resistance during extrusion. The teaching of this patent is to cool rapidly down to a temperature where precipitation of the hardening elements takes place, specified to a temperature of 425° C. or below.

It is well known from the binary Al—Fe, Al—Mn, Al—Cr etc. phase diagrams that the solubility of Fe, Mn, Cr etc. decreases with decreasing temperature below the eutectic or peritectic temperatures of the said phase diagrams. There are, however, limited experimental data on the effect of temperature on the solubility of non-hardening elements in Al—Mg—Si(—Cu)-alloys, and the inventors of the present invention have not encountered any reported experimental evidence of the influence of the solute level of such non-hardening elements on the extrudability of Al—Mg—Si(—Cu) alloys. In investigations of the effect of homogenization temperature on the billet microstructure of a 6061-alloy (M. J. Couper et al.: in: P. R. Whiteley: *Aluminium Cast House Technology, TMS,* 2001) and a 6063-alloy (M. J. Couper et al., *Proc. ET* 2000 p. 51) attempts of measuring the solute Fe and Mn have been made, but these measurements do not indicate any effect of the homogenization temperature on the solute levels of Fe and Mn. No data on extrudability were reported for the 6061-alloy, whereas for the 6063-alloy no particular influence of the homogenization temperature on the breakthrough pressure was noted.

It is possible to estimate the solubility of non-hardening elements in Al—Mg—Si(—Cu) alloys by using thermodynamic calculations, such as for instance by the Thermocalc software. One calculation performed in a PhD-thesis (N. Kuijpers; *PhD thesis*, T. U. *Delft,* 2004 p. 111) indicates a clear tendency to lower solubility with lower temperature. It is not considered in this publication whether this may have any influence on the extrudability. With the present invention it has been found that it is possible to achieve considerable improvements in extrudability of Al—Mg—Si(—Cu) extrusion alloys by applying a method which involves bringing the homogenized alloys in a controlled manner from the homogenization temperature and down to a lower temperature as defined one or more embodiments of the present application.

Figure 2:
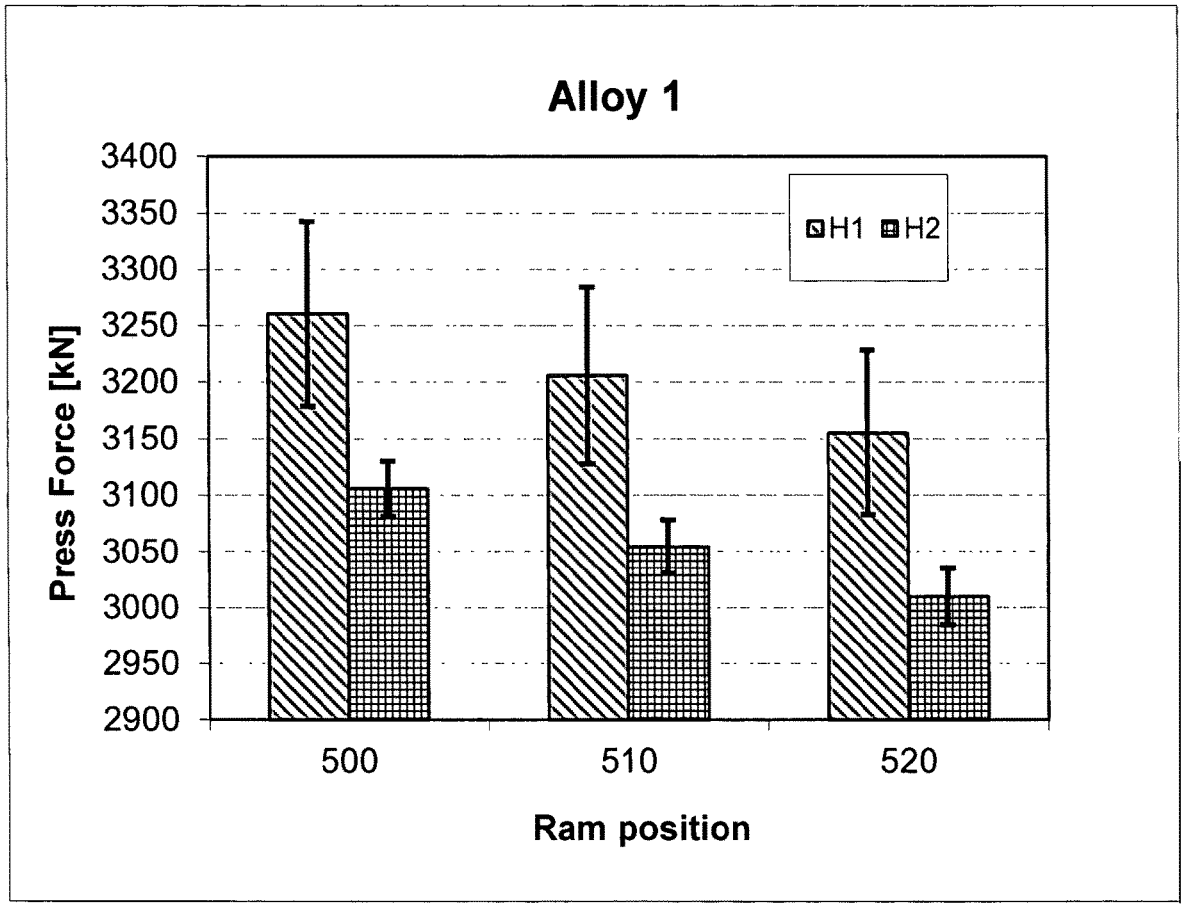
Figure 3:
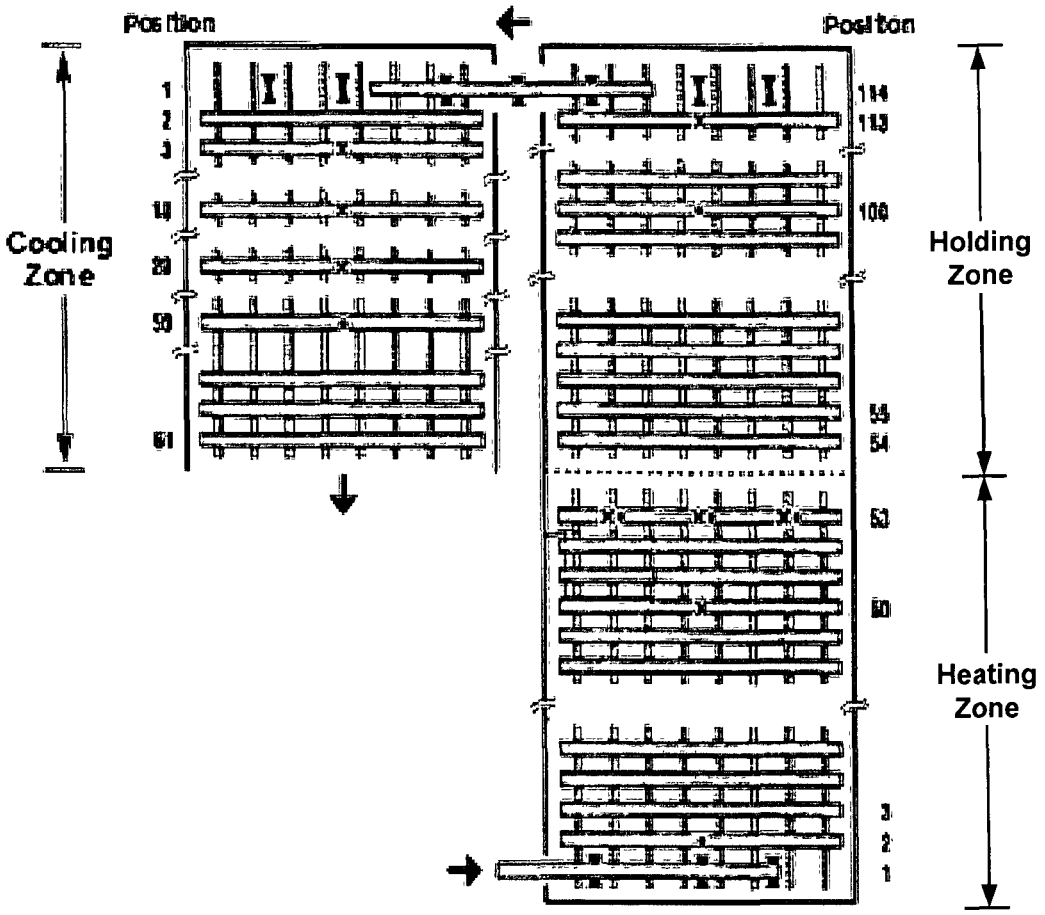
Figure 4:
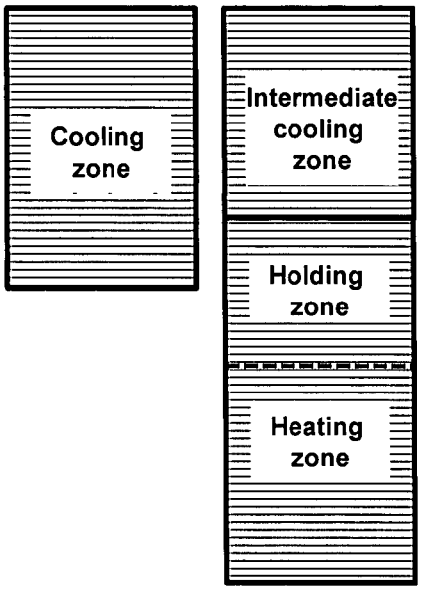
Figure 5:
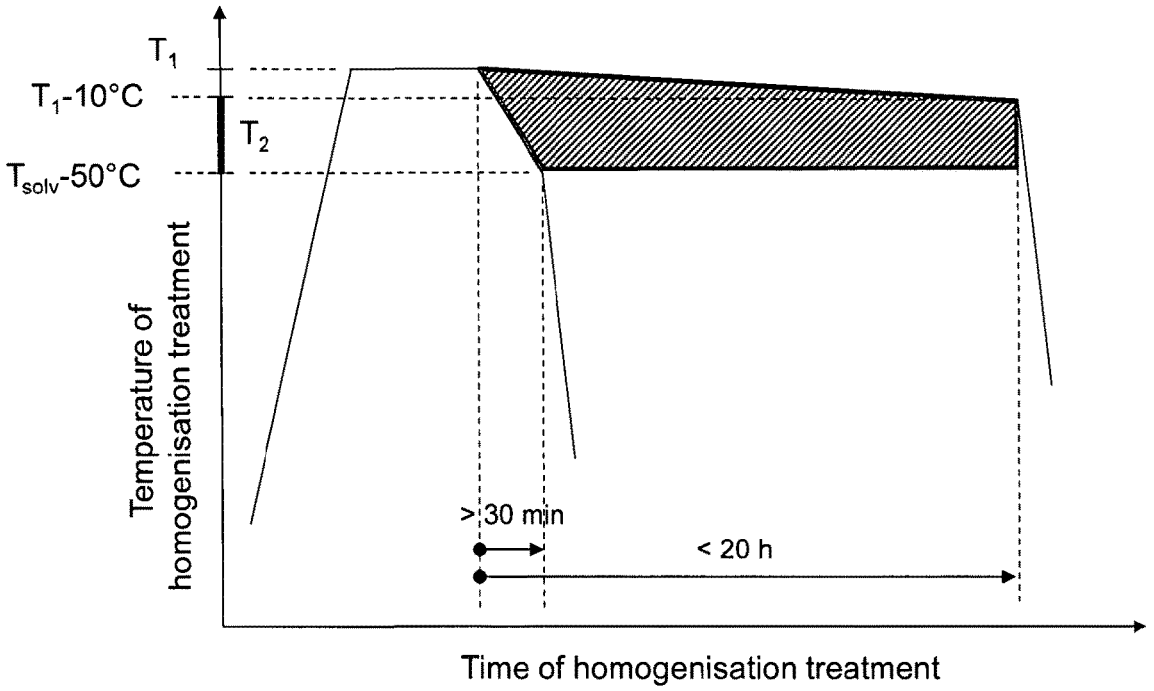

The invention will be further described in the following by way of examples and with reference to the drawings and figures where:

FIG. 1 is an illustration of how the invention relates to the solvus lines of hardening (Mg, Si) and non-hardening (Fe, Mn) elements FIG. 2 shows the extrusion pressure at different ram positions for two homogenisation cycles H1 and H2 according to the invention FIG. 3 is a sketch showing an example of a layout of a conventional continuous homogenisation furnace FIG. 4 is a sketch showing an example of a layout of an improved continuous homogenisation furnace according to the invention FIG. 5 is another sketch of a temperature-time chart for the intermediate cooling segment of homogenisation according to the invention.

Figure 6:
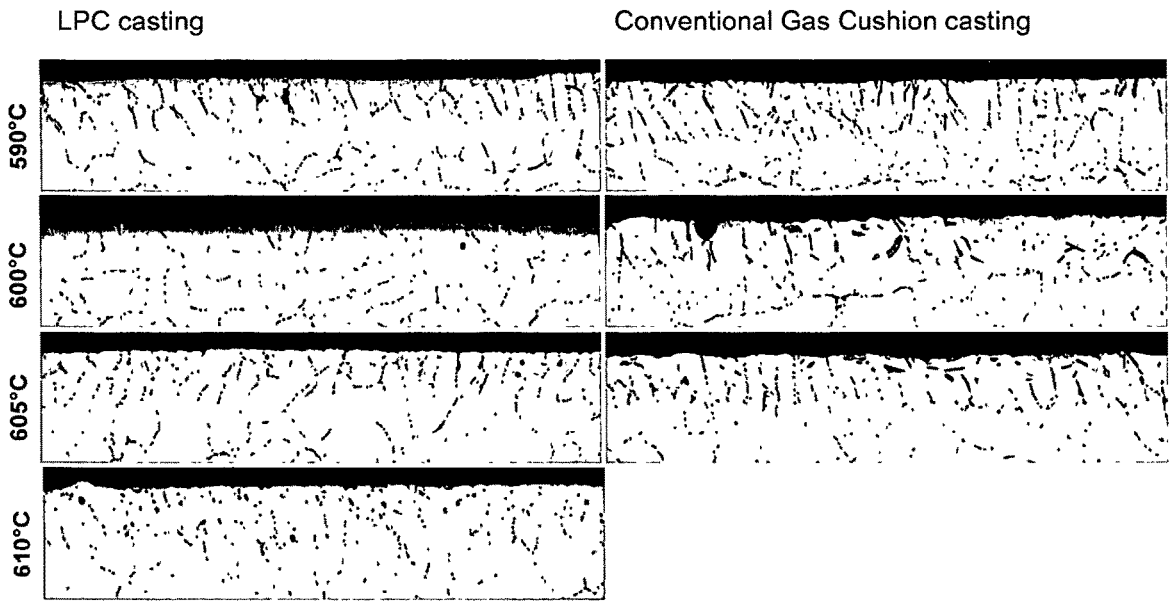

FIG. 6 is a set of micrographs of the inverse segregation zone of LPC cast billets and conventional gas cushion cast billets of a 6060-alloy after homogenisation at the indicated temperatures.

The normal homogenization practice for Al—Mg—Si(—Cu) alloys is to heat the material to the desired holding temperature, keep it at the holding temperature for a certain length of time, and then cool with forced air to room temperature. With the present invention It has been found by the inventors that it is possible to achieve considerable improvements in extrudability by applying a method which involves bringing the homogenized material from the homogenization temperature $T_1$ down to a lower temperature $T_2$ before forced air cooling, $T_2$ being at least 10° C. lower than $T_1$, for the purpose of bringing non-hardening elements out of solid solution. In many cases, choosing $T_2$ close to the solvus temperature with respect to the hardening elements may be optimal. The method may be a slow cooling to the temperature $T_2$ where the forced air cooling starts, or a second holding segment at the lower temperature $T_2$, or even cooling to a temperature $T_3$ lower than $T_2$, then reheating to $T_2$ before the onset of forced air cooling. Any of these methods are referred to as "intermediate cooling segment".

The principle of the method is further described with reference to FIG. 1, relating to an arbitrary Al—Mg—Si alloy with some content of Fe and Mn. The left side of the figure illustrates the solvus and solidus lines of Mg+Si in the alloy, whereas the right side of the figure illustrates the solvus lines of Mn and Fe in the alloy. It will normally be convenient to homogenise at a high temperature $T_1$, however safely below the solidus line for Mg and Si. At this high temperature, the time it takes to achieve the desired transformation and spheroidisation of the AlFeSi-particles is minimized. At this temperature, a certain portion of the Fe and Mn is tied up in particles, as illustrated by the double arrow at the temperature $T_1$ in the right side of the figure, whereas a certain fraction is found in solid solution as indicated in the horizontal axis in the right side of the figure.

To use the principle of the invention one can lower the temperature from $T_1$ to $T_2$, where $T_2$ may be at or above the solvus line for Mg+Si, and given that the time used to reduce the temperature, and/or the time applied at $T_2$, is long enough a considerable reduction in solute content of Mn and Fe is possible. The Fe and Mn that goes out of solid solution goes to particles, either pre-existing or by forming new ones, and it is possible to measure an increased volume fraction of particles in the alloys at $T_2$ compared to $T_1$, as illustrated on the right side of FIG. 1. The minimum achievable content of Mn and Fe in solid solution at the temperature $T_2$ is given on the horizontal axis on the right side of FIG. 1. It is not necessary for the applicability of the invention that the minimum solute content of Fe and Mn at $T_2$ is reached, it is sufficient that a partial reduction in solute content takes place. After a satisfactorily reduction of Fe and Mn from solid solution has taken place, rapid cooling from the temperature $T_2$ is applied.

It may be convenient to choose the temperature $T_2$ to be equal to or slightly higher than the solvus temperature, as in the description above. In this way, one will never risk the formation of $Mg_2Si$ particles before the onset of rapid cooling. At temperatures only slightly below the solvus temperature, however, it takes long time before the precipitation of $Mg_2Si$ takes place. This is known from the literature (for example B. Milkereit et al., *Mater. Sci. Eng. A vol.* 550 (2012) pp 87-96). Thus, it is possible to design a cooling practice where $T_2$ may be lower than the solvus temperature, and thereby achieve a further reduction of the solid solution content of Fe, Mn and other non-hardening elements.

It is also possible to cool the metal from the temperature $T_1$ to a temperature $T_3$ lower than the $Mg_2Si$ solvus temperature, allow for some $Mg_2Si$ particles to form while simultaneously bringing more non-hardening elements out of solid solution, and then reheat the material to a temperature $T_2$ above the $Mg_2Si$ solvus temperature for sufficient time to dissolve the $Mg_2Si$ particles before the onset of rapid cooling The following examples show the benefit of using an intermediate cooling segment:

EXAMPLE 1

Alloy 1 of Table 1 were subjected to two different homogenization treatments:

H1—Rapid heating to 575° C., holding at this temperature for 2 h and 15 min, and then rapidly cooled from this temperature with forced air at an average rate of approx. 400° C./h in the temperature interval 500° C.-250° C.

H2—Rapid heating to 585° C., holding at this temperature for 15 min, cooling down to 505° C. at a rate of 40° C./h, then rapid cooling with forced air at an average rate of approx. 400° C./h in the temperature interval 500° C.-250° C.

Extrusion billets for the alloys were extruded at a laboratory extrusion press, and the extrusion pressure at different ram positions was measured and is shown in FIG. 2. It is seen that the homogenization cycle H2 leads to a reduction in extrusion pressure compared to the cycle H1.

The reduction in pressure may seem moderate, but even small differences in extrusion pressure may give considerable gain in extrusion productivity. For lean extrusion alloys like the one in this example, the achieved reduction in extrusion pressure may lead to a 5-10% increase in the critical extrusion speed before tearing of the profile takes place. This improvement is particularly useful for the extrusion of complex shapes.

EXAMPLE 2

Alloy 2 of Table 1 was subjected to two different homogenisation treatments:

H3: Rapid heating to 580° C., holding at this temperature for 2 h 30 min, cooling at 60° C./h down to 520° C. and then rapid cooling with forced air at an average rate of approx. 300° C./h in the temperature interval 500° C.-250° C.

H4: Rapid heating to 580° C., holding at this temperature for 2 h 30 min, cooling at 12° C./h down to 520° C. and then rapid cooling with forced air at an average rate of approx. 300° C./h in the temperature interval 500° C.-250° C.

The alloy is used for complex hollow shapes that are sensitive to changes in the extrusion pressure of the alloy. Full-scale extrusion trial indicated that there was a gain of approx. 30% in productivity of the homogenisation practice H4 over the practice H3.

EXAMPLE 3

Alloy 3 of Table 1 was subjected to 2 different homogenisation treatments:

H1 as described in Example 1

H5: rapid heating to 585° C., holding at this temperature for 10 h, cooling at 10° C./h down to 535° C. and then rapid cooling with forced air at an average rate of approx. 400° C./h in the temperature interval 500° C.-250° C.

Extrusion billets for the alloys were extruded at a laboratory extrusion press, and the extrusion pressure was measured to be approx. 3% lower for material homogenized by the procedure H5 compared to the procedure H1.

Again, a 3% reduction in pressure may seem moderate, but for high alloyed alloys like in this example the acceleration time of the extrusion press may be an issue. The acceleration time depends strongly on the extrusion pressure. For critical profiles, a 3% reduction in extrusion pressure may give a productivity increase of 10% or more.

The improvements in extrusion pressure and extrudability achieved in the examples above are believed to be related to a lower solute level of non-hardening elements by the new procedures. Measuring the solute level of Al—Mg—Si(—Cu) alloys is a challenging task. An indirect way of doing such measurements is to measure the volume fraction of particles formed by the non-hardening elements.

EXAMPLE 4

Alloy 1 of Table 1 was homogenised at 595° C. and 575° C. for a fixed length of time, and then water-quenched from this temperature. Automated image analyses of the resulting microstructure with light optical microscope indicates that the volume fraction of non-hardening particles increases from approx. 0.65% after homogenisation at 595° C. to approx. 0.80% after homogenisation at 575° C., indicating a considerable reduction of non-hardening elements in solution after homogenisation at the lower temperature.

TABLE 1

Alloys used in the examples. Compositions are in wt. %.

| Alloy | Si | Fe | Cu | Mn | Mg | Cr | Ti |
|---|---|---|---|---|---|---|---|
| 1 | 0.45 | 0.20 | — | 0.05 | 0.37 | — | 0.01 |
| 2 | 0.70 | 0.20 | 0.10 | 0.24 | 0.45 | 0.09 | 0.02 |
| 3 | 1.01 | 0.23 | — | 0.40 | 0.66 | — | 0.03 |

Electric and Thermal Conductivity

An interesting side-effect of removing non-hardening elements from solid solution by the methods described above is an increase in the electrical conductivity of the alloys. This is particularly useful for alloys used for electric conductors, such as busbars. The thermal conductivity is also affected by the content of non-hardening elements in solid solution, and the present method is useful for optimising the thermal conductivity for products such as heat sinks.

Practical Ways of Implementing the Method in the Casthouse

Extrusion billets of the Al—Mg—Si(—Cu) type are normally homogenised in the casthouse before transportation to the extrusion plant. There are two common types of homogenisation furnaces; batch homogenisation furnaces and continuous homogenisation furnaces.

Batch Homogenisation Furnace

In batch type of homogenisation furnaces the common procedure for homogenization is to insert a load of billets into a furnace chamber, then heat the billets to the desired homogenisation temperature and keep the billets at this temperature in the furnace chamber for a desired length of time. After the holding time, the furnace billet load is removed from the furnace chamber and cooled. Cooling is usually done in a cooling chamber where the furnace load is cooled rapidly in forced air.

Large casthouses may have several furnace chambers and cooling chambers. Since the heating and holding segment in the furnace chamber takes longer time than cooling in the cooling chamber the number of furnace chambers in a large casthouse may be larger than the number of cooling chambers.

For the present invention batch homogenization arrangements, i.e. operation of the furnace chambers and cooling chambers, may be applied in several practical ways, but not limited to the examples given below:

1—Cooling from the temperature $T_1$ to a temperature $T_2$ in the furnace chamber, then move the furnace load to the cooling chamber 2—Removing the furnace load from the furnace chamber at $T_1$, cooling to a temperature $T_2$ outside the chambers, then move the furnace load to the cooling chamber.

3—Moving the furnace load from the furnace chamber at $T_1$ to the cooling chamber, cool at a slow rate to a temperature $T_2$ in the cooling chamber, then increase the cooling speed in the cooling chamber.

4—Moving the furnace load from the furnace chamber at $T_1$ to a second furnace chamber at the temperature $T_2$, keep the load in the second furnace chamber for the desired length of time and then move the furnace load to the cooling chamber 5—Cooling the furnace load from the temperature $T_1$ to a temperature $T_3$ lower than $T_2$ by any method, then reheat to the temperature $T_2$ in a furnace chamber and finally move the furnace load to the cooling chamber.

Continuous Homogenisation Furnace

A continuous homogenisation furnace is normally divided in three parts, a heating zone, a holding zone and a cooling zone. The individual logs of extrusion ingots are moved through the zones of the furnace. FIG. 3 is a sketch of a continuous homogenisation furnace. A normal layout is to have the heating zone and the holding zone in the same chamber, with ample heating capacity in the heating zone and sufficient heaters to keep the metal temperature at the desired temperature in the holding zone. The cooling zone is normally in a separate chamber, the logs are transferred from the holding zone to the cooling zone when they have reached the end of the holding zone.

There are at least two practical approaches of how to operate the continuous homogenisation furnace for making use of the present invention. The methods may require modifications of the homogenisation furnace, depending on the existing furnace design.

1—Slow initial cooling in the cooling zone. Most cooling chambers are designed to air-cool the extrusion logs rapidly. A slow initial cooling will require modification of the cooling zone, with little or no air flow in the first part of the cooling zone and a high air flow in the last part of the cooling zone. This will require the installation of a valve to separate the air-flow between the two parts of the cooling zone. The main drawback of such a solution is that due to the shortened length of the rapid-cooling-zone, it will lead to a slow throughput of extrusion logs in the homogenisation furnace. This can be overcome by installing an additional cooling device, for instance a water quench device, at the end of the conventional cooling zone.

2—Instead of transferring the extrusion logs to the cooling zone it may be practical to transfer the logs to a purpose-built holding station. In its simplest design, this may just be an open-air storage where the billets are allowed to slowly cool to the desired temperature before the next transfer to the cooling zone. Since the cooling rate in air depends on the billet diameter, an open-air storage will be more useful for large billet diameters, and less useful for small billet diameters. A more sophisticated design may consist of a separate holding chamber with options for controlled cooling and possibly also options for heating. The main drawback for a holding-station solution is the cost of design, construction and installation of such a station, as well as the extra space that a holding station will occupy in the casthouse.

3—It is possible to use the holding zone for the slow cooling of the extrusion logs. The extrusion logs are brought to the temperature $T_1$ in the heating zone, whereas the temperature in the holding zone is set to a lower temperature $T_2$. The extrusion logs will then gradually approach the temperature $T_2$ while moving through the holding zone. There is normally a certain air-flow between the heating zone and the holding zone. It may lead to difficulties in reaching the desired temperature $T_2$ in the holding zone if there is a flow of hotter air from the heating zone. It may therefore be necessary to install a valve or some other obstacle for the air-flow between the heating zone and the holding zone. The necessity for such a modification is dictated by the design of the continuous homogenisation furnace in question, the temperature difference between $T_1$ and $T_2$, and the billet diameter.

If the temperature difference between $T_1$ and $T_2$ is large and/or if the billet diameter is large, it may be necessary to improve the cooling capacity in the holding zone. The cooling capacity can be increased either by increasing the flow-rate of air at the temperature $T_2$ in the holding zone, or to install fans that cool with ambient air in the start of the holding zone. With cooling from ambient air it is possible to cool the extrusion logs rapidly down to the temperature $T_2$, and the temperature-time profile of the individual extrusion log in the holding zone will then have the character of a holding step at $T_2$ rather than a cooling step from $T_1$ to $T_2$. Cooling from ambient air also allows for a cooling to of the logs to a temperature $T_3$ lower than $T_2$, and then re-heating to $T_2$ before reaching the end of the holding zone.

The main drawback of using the holding zone for cooling the extrusion logs to the temperature $T_2$ is that the time at the temperature $T_1$ will be very short. Two of the purposes of the homogenisation method are to change the type and primary Fe-based particles from the β-AlFeSi-type to the α-AlFeSi-type, and to achieve a high degree of spheroidisation of the α-AlFeSi particles. Both of these processes are facilitated by higher homogenization temperatures and longer homogenization times. Merely heating the extrusion logs to the temperature $T_1$ in the heating zone and then cool them to $T_2$ may lead to unsatisfactorily low degree of β-AlFeSi to α-AlFeSi particle transformation as well as unsatisfactorily low degree of spheroidisation. This may be compensated for by setting the temperature $T_1$ to a higher value than what is common in the industry. For many alloys, a temperature $T_1$ in the range 570° C.-585° C. is commonly used in the industry. Experiments have shown that the degree of β-AlFeSi to α-AlFeSi particle transformation as well as the degree of spheroidisation after 15 minutes at 595° C. is comparable to that after 2¼ hours at 575° C. Thus, with such temperature setpoint for $T_1$ the degree of spheroidisation will be in the normal range even if the extrusion logs are cooled to a lower temperature $T_2$ in the holding zone.

For commissioning of new continuous homogenisation furnaces, the present invention may call for a design other than the traditional heating-zone, holding-zone, cooling zone set-up. FIG. 4 shows a simple sketch of an applicable design following the description in point 3 above. The heating zone leads to the holding zone in the same manner as in the conventional design, the transition is marked with a stapled line. At the end of the heating zone, there is a thermal barrier, marked with a solid line, before transfer to the intermediate cooling zone. The intermediate cooling zone may contain both fans from ambient air and heaters in order to regulate the temperature within the desired limits. At the end of the intermediate cooling zone, where the extrusion billets have the temperature $T_2$, they are transferred to the cooling chamber in a conventional manner, for rapid cooling with forced air.

During casting of extrusion ingots, a solute-enriched zone is formed close to the billet surface. This zone is commonly referred to as Inverse Segregation Zone, or ISZ, and the average thickness of the zone is typically in the range 50-200 μm, but can be even narrower or even wider, depending on factors such as casting technology, alloy composition and billet diameter. The enrichment of solute in this zone leads to a lower melting point, or more precisely a lower solidus-temperature, in the ISZ than in the rest of the extrusion ingot. This imposes a practical limitation on the maximum setting of the temperature $T_1$ in the homogenisation furnace, since partial melting of the ISZ may lead to undesired defects in the billet surface and undesired microstructural changes in the ISZ. In order to explore the full advantage of using the holding zone for slow cooling by using a high setting for $T_1$ in the heating zone in the continuous homogenisation furnace, it is therefore desirable to use extrusion ingots produced in such a manner that the solute enrichment in the ISZ is minimized. A casting technology for producing extrusion ingots with such characteristics has recently been developed (B. A. Heggset et al: US patent application 2006/0219378). With this casting technology, known as LPC casting, it has been proven possible to use a homogenisation temperature $T_1$ of at least 610° C. for lean Al—Mg—Si alloys without partial melting reactions taking place in the ISZ as demonstrated in FIG. 6.

The invention claimed is:

1. A method for manufacturing an Al—Mg—Si(—Cu) extrusion alloy comprising:

casting one or more billets of an alloy comprising, in wt %:

Si: 0.20-1.50
Mg: 0.25-1.50
Fe: 0.05-0.50
Cu: 0.00-1.00
Mn: 0.00-1.00
Cr: 0.00-0.50
Zn: 0.00-0.50
Ti: 0.00-0.20, and
incidental impurities and a balance of Al, heating the one or more billets to a homogenisation holding temperature $T_1$ between 520° C. and 620° C. and holding the one or more billets at the homogenisation holding temperature $T_1$ for a predetermined time, cooling the one or more billets from the homogenisation holding temperature $T_1$ to a temperature $T_2$, and further cooling the one or more billets at a rate of 150° C./h or faster, wherein the temperature $T_2$ is at least 10° C. lower than the temperature $T_1$ and at or above the solvus line for Mg+Si, and wherein the cooling the one or more billets at a rate of 150° C./h or faster begins 30 minutes to 20 hours after the completion of the holding the one or more billets at the homogenisation holding temperature $T_1$ for a predetermined time so that a reduction of the solute content of Mn and Fe takes place.

2. The method according to claim 1, wherein the one or more billets are cooled monotonically from the temperature $T_1$ to the temperature $T_2$.

3. The method according to claim 1, wherein a holding time of up to 20 hours at the temperature $T_2$ is applied.

4. The method according to claim 1, wherein an average intermediate cooling rate between the homogenisation holding temperature $T_1$ and the onset of the cooling the one or more billets at a rate of 150° C./h or faster is <150° C. per hour but >4° C. per hour.

5. The method according to claim 1, wherein the alloy comprises, in wt %:

Si: 0.30-0.6
Mg: 0.35-0.6
Fe: 0.10-0.30
Cu: 0.00-0.10
Mn: 0.00-0.10
Cr: 0.00-0.05
Zn: 0.00-0.15
Ti: 0.00-0.10, and
incidental impurities and a balance of Al.

6. The method according to claim 1, wherein the alloy comprises, in wt %:

Si: 0.20-0.6
Mg: 0.45-0.9
Fe: 0.05-0.35
Cu: 0.00-0.10
Mn: 0.00-0.10
Cr: 0.00-0.10
Zn: 0.00-0.10
Ti: 0.00-0.10, and
incidental impurities and a balance of Al.

7. The method according to claim 1, wherein the alloy comprises, in wt %:

Si: 0.50-0.9
Mg: 0.40-0.7
Fe: 0.05-0.35
Cu: 0.00-0.30
Mn: 0.00-0.50
Cr: 0.00-0.30
Zn: 0.00-0.20
Ti: 0.00-0.10, and
incidental impurities and a balance of Al.

8. The method according to claim 1, wherein alloy the comprises, in wt %:

Si: 0.7-1.3

Mg: 0.6-1.2

Fe: 0.05-0.50

Cu: 0.00-0.10

Mn: 0.40-1.0

Cr: 0.00-0.25

Zn: 0.00-0.20

Ti: 0.00-0.10 incidental impurities and a balance of Al.

9. A method for manufacturing an Al—Mg—Si(—Cu) extrusion alloy comprising:

casting one or more billets of an alloy comprising, in wt %:

Si: 0.40-0.8

Mg: 0.8-1.2

Fe: 0.05-0.7

Cu: 0.15-0.40

Mn: 0-0.15

Cr: 0.04-0.35

Zn: 0-0.25

Ti: 0-0.15, and incidental impurities and a balance of Al, heating the one or more billets to a homogenisation holding temperature $T_1$ between 520° C. and 620° C. and holding the one or more billets at the homogenisation holding temperature $T_1$ for a predetermined time, cooling the one or more billets from the homogenisation holding temperature $T_1$ to a temperature $T_2$, and further cooling the one or more billets at a rate of 150° C./h or faster, wherein the temperature $T_2$ is at least 10° C. lower than the temperature $T_1$ and at or above the solvus line for Mg+Si, and wherein the cooling the one or more billets at a rate of 150° C./h or faster begins 30 minutes to 20 hours after the completion of the holding the one or more billets at the homogenisation holding temperature $T_1$ for a predetermined time so that a reduction of the solute content of Mn and Fe takes place.

* * * * *